US007121799B2

(12) United States Patent
Kim et al.

(10) Patent No.: US 7,121,799 B2
(45) Date of Patent: Oct. 17, 2006

(54) TURBOFAN AND MOLD MANUFACTURING THE SAME

(75) Inventors: Jin Baek Kim, Suwon (KR); Hyoung-Mo Koo, Anyang (KR); Weon-Seok Choi, Seoul (KR); Yong Seok Kim, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 204 days.

(21) Appl. No.: 10/748,230

(22) Filed: Dec. 31, 2003

(65) Prior Publication Data

US 2004/0247441 A1 Dec. 9, 2004

(30) Foreign Application Priority Data

Jun. 3, 2003 (KR) ..... 10-2003-0035569

(51) Int. Cl.
*F04D 29/30* (2006.01)

(52) U.S. Cl. ..... 416/186 R; 416/188; 416/223 B; 416/234

(58) Field of Classification Search ..... 416/178, 416/185, 186 R, 187, 188, 223 B, 234
See application file for complete search history.

(56) References Cited

U.S. PATENT DOCUMENTS

| | | | | |
|---|---|---|---|---|
| 1,919,970 | A | 7/1933 | Woods | |
| 2,482,462 | A | 9/1949 | Browne | |
| 3,842,902 | A | 10/1974 | Poslusny | |
| 6,146,094 | A | 11/2000 | Obana et al. | |
| 6,558,120 | B1 * | 5/2003 | Kim et al. | 416/186 R |
| 6,604,906 | B1 | 8/2003 | Ozeki et al. | |
| 6,746,210 | B1 * | 6/2004 | Kim | 416/186 R |
| 6,848,887 | B1 * | 2/2005 | Kim | 416/186 R |
| 6,942,459 | B1 * | 9/2005 | Li et al. | 416/178 |
| 2003/0077174 | A1 * | 4/2003 | Kim | 416/186 R |

FOREIGN PATENT DOCUMENTS

| | | | | |
|---|---|---|---|---|
| JP | 1-193099 A | * | 8/1989 | 416/178 |

OTHER PUBLICATIONS

Patent Abstracts of Japan for Publication No. 07-016884, dated Jan. 20, 1995.

Korean Patent Abstracts for Publication No. 1020020086142, dated Nov. 18, 2002.

Korean Patent Abstracts for Publication No. 1020030012623, dated Feb. 12, 2003.

(Continued)

*Primary Examiner*—Christopher Verdier
(74) *Attorney, Agent, or Firm*—Staas & Halsey LLP

(57) ABSTRACT

A mold to mold an integral turbofan having a rotating plate joined to a drive motor, an outer ring concentrically disposed outside of the rotating plate with a spacing therebetween, a plurality of blades radially arranged on a front face of the rotating plate and integrally connected at rear ends thereof to the rotating plate and the outer ring, and a shroud integrally formed with front ends of the blades. The mold includes a first half having first, second and third front parts forming a front face of the rotating plate, the shroud and the outer ring, respectively, and a second half combining with the first half, and including a first rear part forming a rear face of the rotating plate, a plurality of second rear parts forming a rear face of the shroud and the blades, and a third rear part forming a rear face of the outer ring.

14 Claims, 7 Drawing Sheets

OTHER PUBLICATIONS

U.S. Appl. No. 10/748,229, filed Dec. 31, 2003, Jin Baek Kim, et al., Samsung Electronics Co., Ltd., Suwon-si, Republic of Korea.

U.S. Appl. No. 10/748,195, filed Dec. 31, 2003, Jin Baek Kim, et al., Samsung Electronics Co., Ltd., Suwon-si, Republic of Korea.

* cited by examiner

TURBOFAN AND MOLD MANUFACTURING THE SAME

CROSS-REFERENCE TO RELATED APPLICATION

This application claims the benefit of Korean Application No. 2003-35569, filed Jun. 3, 2003, in the Korean Intellectual Property Office, the disclosure of which is incorporated herein by reference.

BACKGROUND OF THE INVENTION

1. Field of the Invention

The present invention relates to a turbofan and a mold for manufacturing the same, and more particularly, to a turbofan and a mold for manufacturing the same, which enables the turbofan to be integrally molded by a single molding process.

2. Description of the Related Art

Generally, a turbofan is a type of centrifugal fan, which is adapted to blow air generated from rotating blades. As shown in FIG. 1, a turbofan comprises a circular rotating plate 1 having a central hub 1*a* to which a rotating shaft of a drive motor (not shown) is coupled, a plurality of blades 2 which are radially disposed at a periphery of the circular rotating plate 1 with regular intervals therebetween such that the plurality of blades 2 are positioned to be perpendicular to the circular rotating plate 1, and a ring-shaped shroud 3 coupled to free ends of the plurality of blades 2 to support the plurality of blades 2.

The turbofan is usually produced by a plastic injection molding process. Since a configuration of the turbofan is complicated, the turbofan is provided with a number of undercuts at the plurality of blades 2, thereby causing a separation of a mold therefrom to be difficult. Therefore, the turbofan is hard to integrally mold by only one molding process. To overcome this disadvantage, a conventional turbofan is produced such that a part A, in which the circular rotating plate 1 and the plurality of blades 2 are integrally molded, and the shroud part 4 are first molded by separate molds, as shown in FIG. 2, and the part A and the shroud part 4 are combined with each other by an ultrasonic fusion or a heat fusion in a subsequent procedure.

However, since the conventional turbofans are produced by a process of molding a plurality of components in the separate molds and joining the plurality of components together, productivity of the conventional turbofans is decreased due to the complicated manufacturing process. Furthermore, since the conventional process of manufacturing turbofans requires a plurality of molds for the plurality of components, manufacturing costs are drastically increased due to production of the molds. Further, since the plurality of components is joined to one another afterward, a defective fraction of products is increased by a poor assembly.

SUMMARY OF THE INVENTION

Accordingly, it is an aspect of the present invention to provide a turbofan and a mold to manufacture the same, which enables the turbofan to be integrally produced by only one molding process so as to improve productivity, and to reduce manufacturing costs.

Additional aspects and/or advantages of the invention will be set forth in part in the description which follows and, in part, will be obvious from the description, or may be learned by practice of the invention.

The above and/or other aspects are achieved by providing a turbofan including a rotating plate joined to a shaft of a drive motor, an outer ring concentrically disposed outside of the rotating plate with a spacing therebetween, a plurality of blades radially arranged on a peripheral portion of a front face of the rotating plate and integrally connected at rear ends thereof to the rotating plate and the outer ring, and a ring-shaped shroud integrally formed with front ends of the plurality of blades.

An external diameter of the rotating plate may be equal to or smaller than an internal diameter of the ring-shaped shroud, and an internal diameter of the outer ring may be equal to or larger than an external diameter of the ring-shaped shroud.

The plurality of blades may be integrally formed with the rotating plate and the outer ring at both ends of rear sides thereof.

The above and/or other aspects are achieved by providing a mold to manufacture a turbofan, including a first mold half having a first front molding part to form a front face of a rotating plate, a second front molding part disposed outside of the first front molding part to form the front face of the ring-shaped shroud, and a third front molding part disposed outside of the second front molding part to form a front face of an outer ring, and a second mold half adapted to combine with the first mold half, and having a first rear molding part disposed at a center of the second mold half to form a rear face of the rotating plate, a plurality of second rear molding parts disposed outside of the first rear molding part, and having shapes corresponding to spaces between a plurality of blades to form a rear face of the ring-shaped shroud and the plurality of blades, and a third rear molding part disposed outside of the plurality of second rear molding parts to form a rear face of the outer ring.

The first mold half may include a plurality of inner molding grooves formed outside of the first front molding part, which extend inwardly beyond an internal diameter of the ring-shaped shroud, so as to mold inner ends of respective blades.

The first mold half may include a plurality of outer molding grooves formed inside of the third front molding part, which extend outwardly beyond an external diameter of the ring-shaped shroud, so as to mold outer ends of respective blades.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENT

Figure 1:
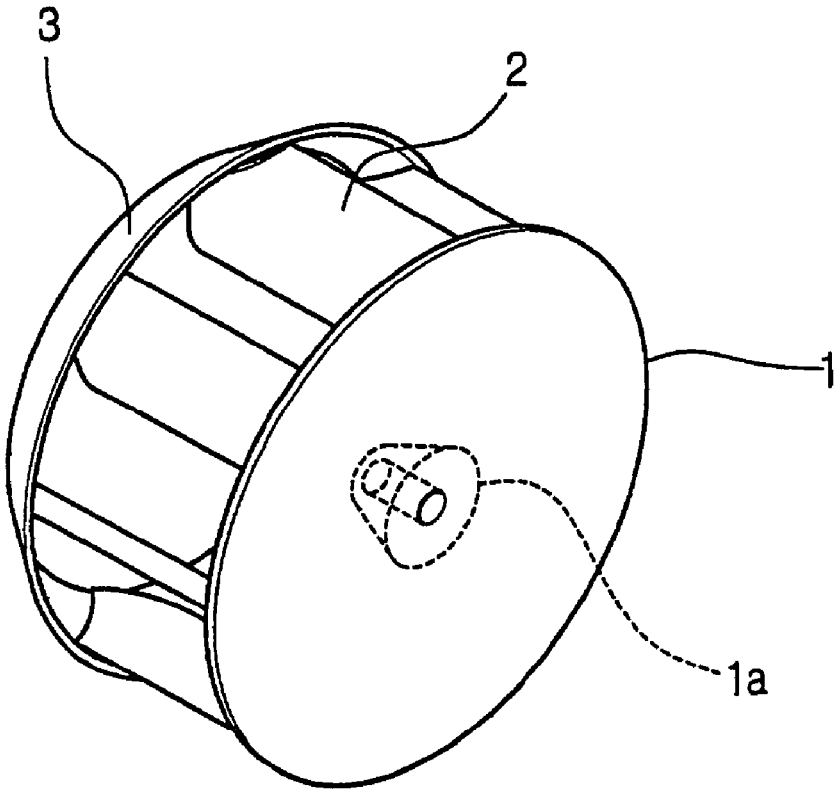
FIG. 1 (Prior Art)
FIG. 1 is a perspective view of a conventional turbofan.
Figure 2:
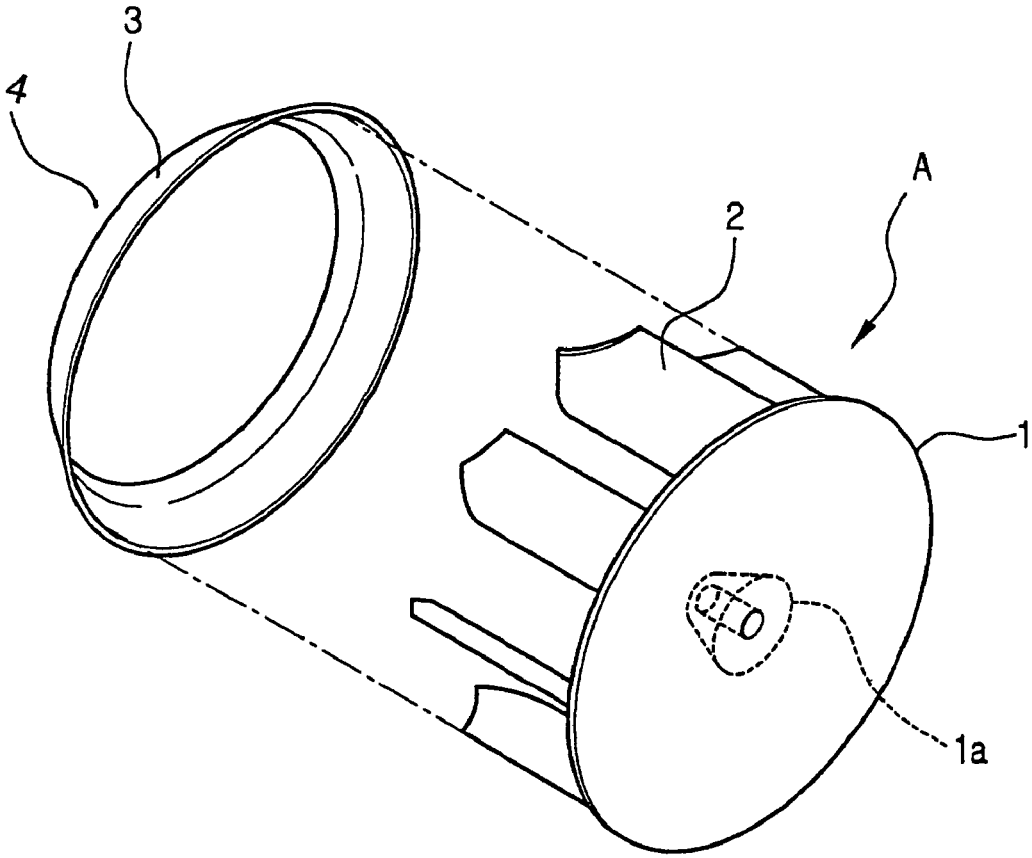
FIG. 2 (Prior Art)
FIG. 2 is an exploded perspective view of the turbofan of FIG. 1.
Figure 3:
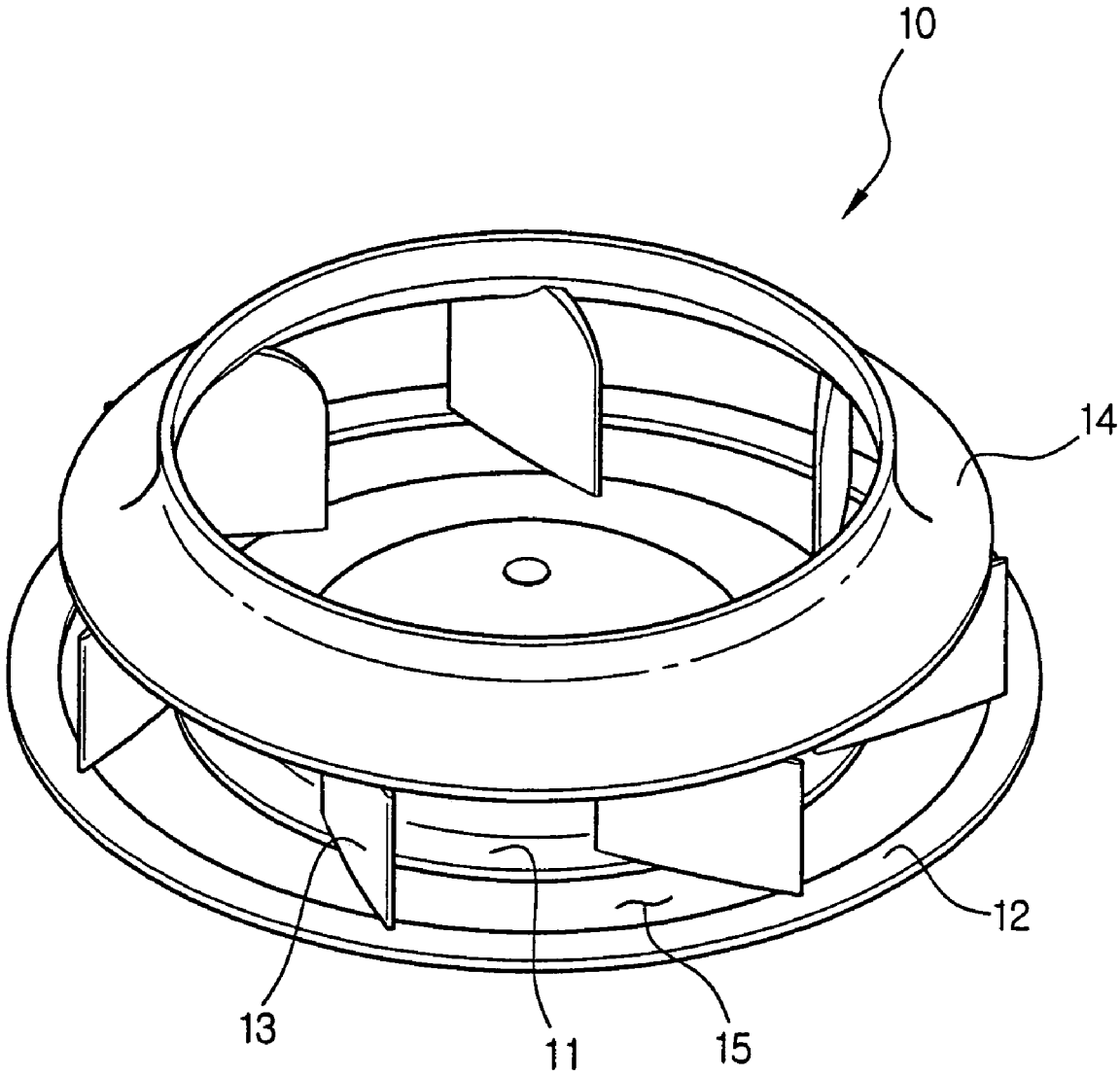
FIG. 3 is a front perspective view of an integral turbofan according to an embodiment of the present invention.
Figure 4:
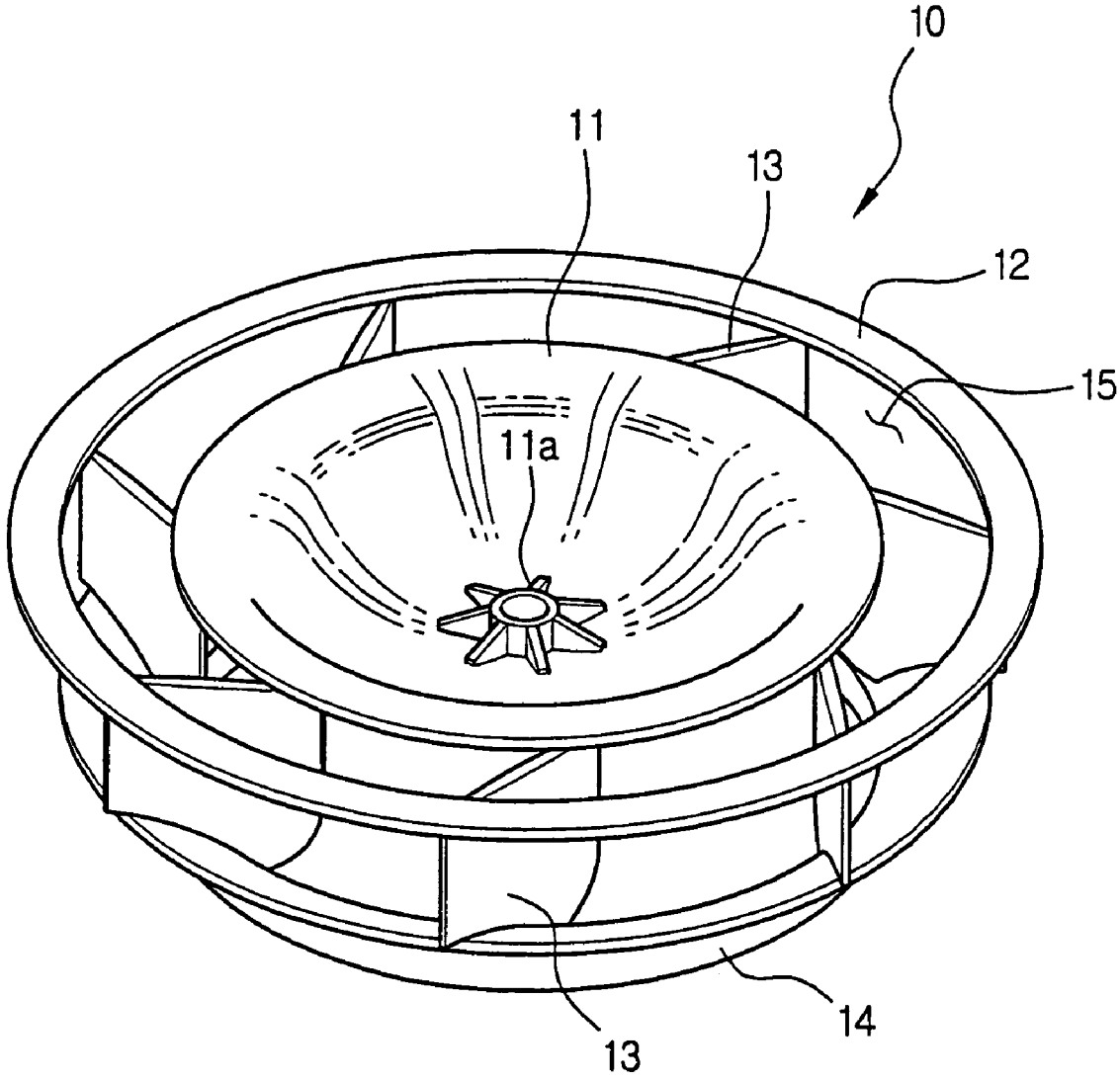
FIG. 4 is a rear perspective view of the integral turbofan shown in FIG. 3.

Reference will now be made in detail to the embodiment of the present invention, examples of which are illustrated in the accompanying drawings, wherein like reference numerals refer to like elements throughout FIGS. 3 and 4 are perspective views showing a turbofan, which is integrally molded by a mold according to an embodiment of the present invention.

As shown in FIGS. 3 and 4, a turbofan 10 includes a circular rotating plate 11 having a central hub 11*a* integrally formed therewith and to which a rotating shaft of a drive motor (not shown) is coupled, and an outer ring 12 concentrically disposed outside of the circular rotating plate 11 with a uniform annular spacing therebetween. The turbofan 10 further includes a plurality of blades 13 which are radially arranged on a peripheral portion of a front face of the circular rotating plate 11 and connected at rear ends thereof to the circular rotating plate 11 and the outer ring 12, and a ring-shaped shroud 14 integrally formed with front ends of the plurality of blades 13 and spaced apart from the circular rotating plate 11.

In the subsequent description, a side, where the ring-shaped shroud 14 is positioned is hereinafter referred to as a front side, while a side, where the circular rotating plate 11 is positioned, is hereinafter referred to as a rear side.

Figure 5:
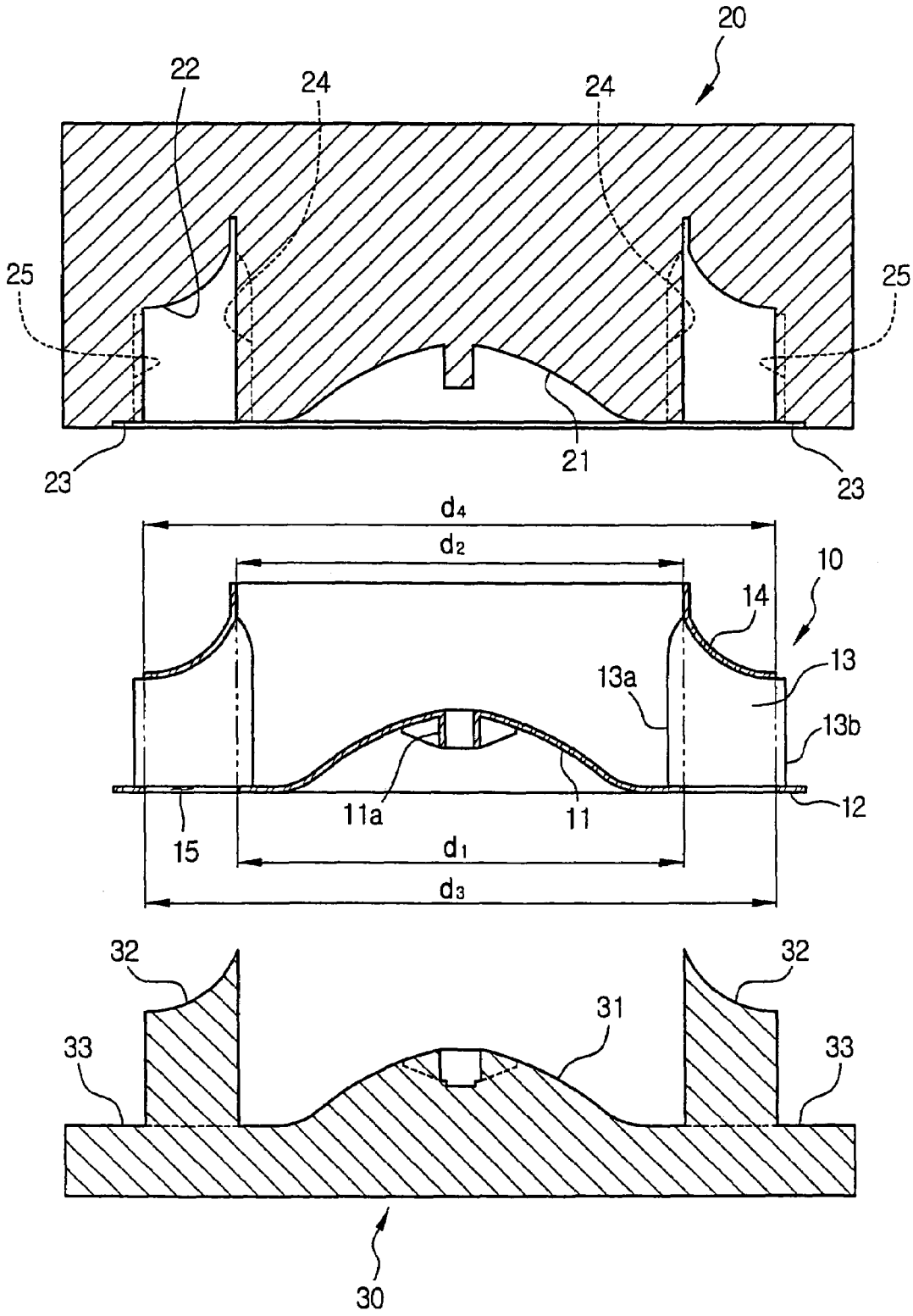
FIG. 5 is an exploded cross-sectional view of a mold to manufacture the turbofan shown in FIG. 3, in which the mold is disassembled.

As shown in FIG. 5, an annular spacing 15 defined between the circular rotating plate 11 and the outer ring 12 enables a mold to mold the plurality of blades 13 and the ring-shaped shroud 14 to easily separate from a molded product during a molding operation of the turbofan 10.

Furthermore, to ease a separation of a mold, an external diameter d1 of the circular rotating plate 11 is designed to be equal to or smaller than an internal diameter d2 of the ring-shaped shroud 14, and an internal diameter d3 of the outer ring 12 is designed to be equal to or larger than an external diameter d4 of the ring-shaped shroud 14. Thus, a radial width of the annular spacing 15 is equal to or larger than a radial width of the ring-shaped shroud 14 so as to allow a mold to easily separate from the molded product. The circular rotating plate 11 and the outer ring 12 are integrally molded via the plurality of blades 13, such that the circular rotating plate 11 and the outer ring 12 are connected to opposite ends of rear sides of the plurality of blades 13, each of which having a radial width thereof larger than the radial width of the annular spacing 15.

When the circular rotating plate 11 joins to a drive motor (not shown), a center of the circular rotating plate 11 protrudes forward into a dome shape so as to enable the turbofan 10 to stably rotate. As shown in FIGS. 3 and 4, the plurality of blades 13 are inclined at a specific angle with respect to radial directions passing through corresponding blades. The ring-shaped shroud 14 is upwardly curled at an inner peripheral portion thereof to have a certain curvature, thereby allowing air introduced into the turbofan 10 to smoothly and radially discharge.

Figure 6:
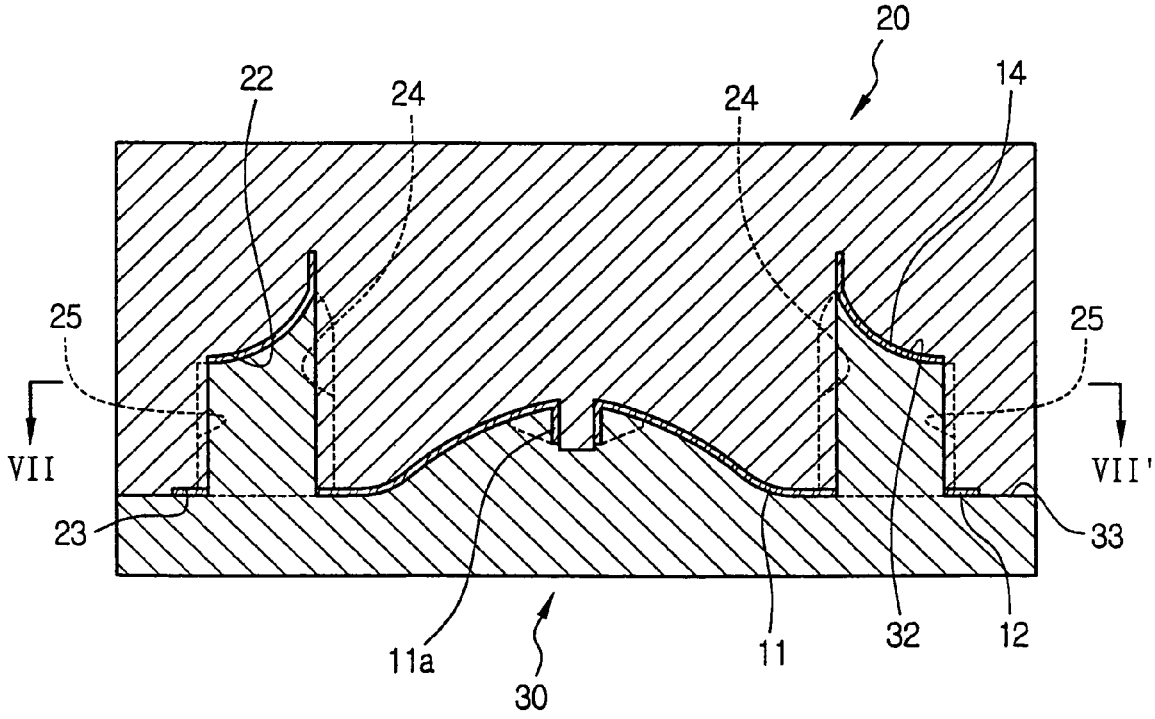
FIG. 6 is a cross-sectional view of the mold shown in FIG. 5, in which the mold is assembled.
Figure 7:
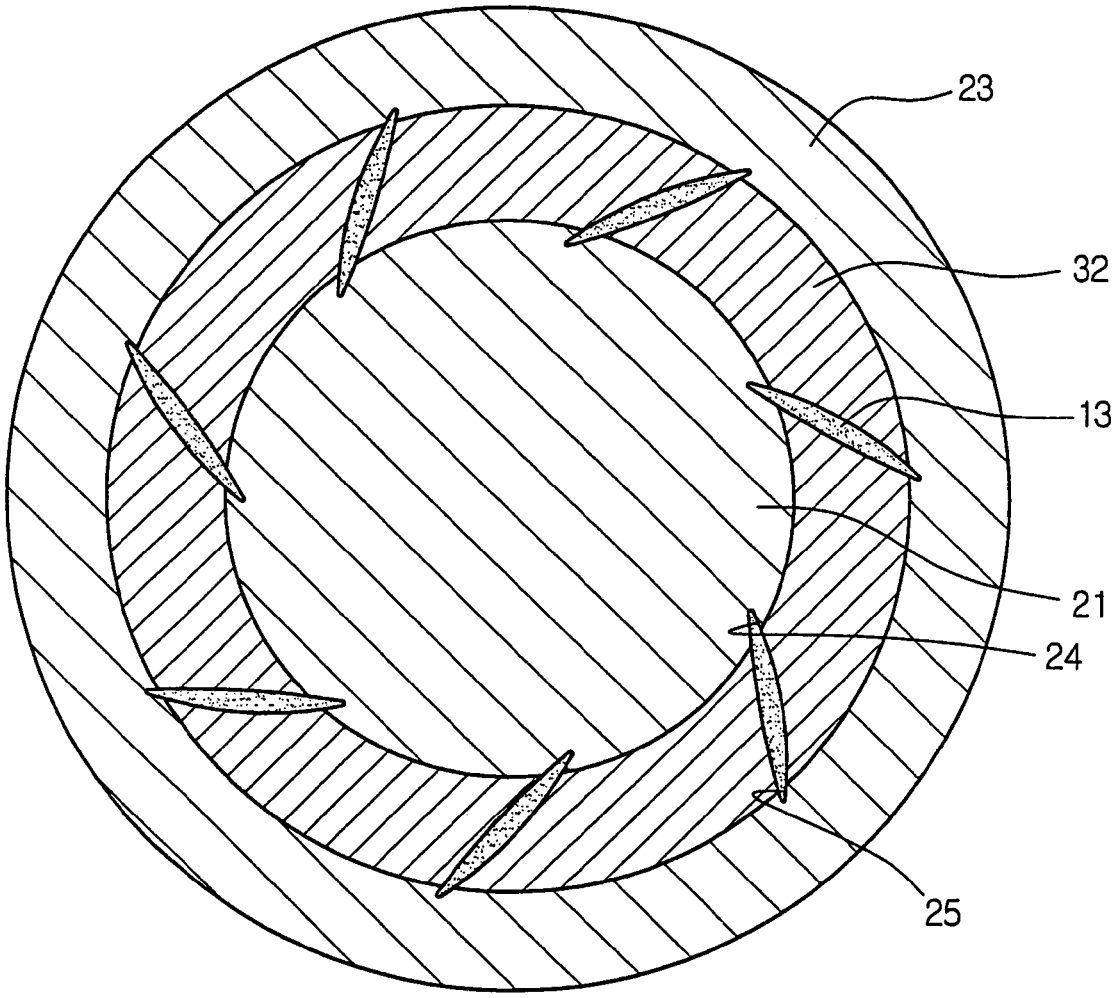
FIG. 7 is a cross-sectional view taken along line VII—VII of FIG. 6.

As shown in FIGS. 5 to 7, a mold to produce the turbofan 10 comprises a first mold half 20 and a second mold half 30, which are combinable with each other and separable from each other.

The first mold half 20 is provided at a center thereof with a first front molding part 21 to form a front face of the circular rotating plate 11, and provided radially outside of the first front molding part 21 with a second front molding part 22 having a surface corresponding to a front face of the ring-shaped shroud 14 to form the front concave face of the ring-shaped shroud 14. The first mold half 20 is further provided radially outside of the second front molding part 22 with a third front molding part 23 to form a front face of the outer ring 12.

The second mold half 30 is provided at a center thereof with a first rear molding part 31 to form a rear face of the circular rotating plate 11, and provided radially outside of the first rear molding part 31 with a plurality of second rear molding parts 32 to form a rear face of the ring-shaped shroud 14 and the plurality of blades 13. As shown in FIG. 7, when the first mold half 20 and the second mold half 30 are combined with each other, the second rear molding parts 32 of the second mold half 30 are moved dose to the second front molding part 22 of the first mold half 20 and occupy respective spaces defined between the plurality of blades 13 of the turbofan 10 with a gap corresponding to a thickness of the ring-shaped shroud 14. The plurality of second rear molding parts 32 are designed such that internal and external diameters of the plurality of second rear molding parts 32 coincide with internal and external diameters of the second front molding part 22 of the first mold half 20 so as to allow the first and second mold halves 20 and 30 to easily combine or separate. As shown in FIG. 5, the second mold half 30 is provided radially outside of the second rear molding parts with a third rear molding part 33 to form a rear face of the outer ring 12.

The first mold half 20 is further provided outside of the first front molding part 21 with a plurality of inner molding grooves 24, which extend in a combining direction of the first mold half 20 and extend in an inward direction beyond the internal diameter d2 of the ring-shaped shroud 14, thereby allowing inner ends 13*a* of the respective blades 13 to form. In addition, the first mold half 20 is provided inside of the third front molding part 23 with a plurality of outer molding grooves 25, which extend in a vertical direction of the first mold half 20 and extend in an outward direction beyond than the external diameter d4 of the ring-shaped shroud 14, thereby forming outer ends 13*b* of the respective blades 13. Accordingly, by the inner and outer molding grooves 24 and 15, the plurality of blades 13 are further provided with the inner ends 13*a* and the outer ends 13*b*, so that the circular rotating plate 11 and the outer ring 12 are integrally molded via the plurality of blades 13 by the inner ends 13*a* and the outer ends 13*b*, which are the extended portions of the plurality of blades 13.

In an operation of molding the turbofan 10 by the mold, the first mold half 20 and the second mold half 30 are first combined with each other to define a molding space therebetween, as shown in FIG. 6. After combining the first and second mold halves 20 and 30, molten resin is injected into the molding space. The molten resin filling the molding space gradually solidifies thus forming the turbofan 10.

After the molding of the turbofan 10 is completed, the first and second mold halves 20 and 30 are separated from each other, and thus the molded turbofan 10 is removed from the first and second mold halves 20 and 30. Further, the second rear molding parts 32 of the second mold half 30 are easily removed from the first mold half 20 through the annular spacing 15 between the circular rotating plate 11 and the outer ring 12.

As is apparent from the above description, a mold is provided, in which even a complex turbofan may be integrally molded by a single molding process, thereby improving a productivity of manufacturing turbofans and substantially reducing manufacturing costs and producing turbofans having uniform quality.

In addition, since the mold can mold blades and a shroud of a turbofan by second rear molding parts of a second mold half, to integrally mold a turbofan having complex blades and to simplify an overall structure of the mold is possible.

Although an embodiment of the present invention has been shown and described, it would be appreciated by those skilled in the art that changes may be made in the embodiment without departing from the principles and spirit of the invention, the scope of which is defined in the claims and their equivalents.

What is claimed is:

1. A turbofan, comprising:

a rotating plate;

an outer ring concentrically disposed outside of the rotating plate with a spacing between the outer ring and the rotating plate;

a plurality of blades radially arranged on a peripheral portion of a front face of the rotating plate and integrally connected at rear ends of the plurality of blades to the rotating plate and the outer ring; and a ring-shaped shroud integrally formed with front ends of the plurality of blades.

2. The turbofan as set forth in claim 1, wherein an external diameter of the rotating plate is equal to or smaller than an internal diameter of the ring-shaped shroud.

3. The turbofan as set forth in claim 1, wherein an internal diameter of the outer ring is equal to or larger than an external diameter of the ring-shaped shroud.

4. The turbofan as set forth in claim 1, wherein each of the blades is integrally formed with the rotating plate and the outer ring at opposite ends of a rear portion of each of the plurality of blades.

5. A turbofan, comprising:

a rotating plate to rotate in the turbofan;

an outer ring concentrically disposed outside of the rotating plate with a spacing between the outer ring and the rotating plate;

a plurality of blades radially arranged at the spacing between the outer ring and the rotating plate, each of the plurality of blades being integrally connected at a rear portion of a respective blade to each of the rotating plate and of the outer ring; and a shroud integrally formed with front ends of the plurality of blades.

6. The turbofan as set forth in claim 5, wherein the shroud is ring-shaped and the rotating plate is circular such that an external diameter of the rotating plate is equal to or smaller than an internal diameter of the ring-shaped shroud.

7. The turbofan as set forth in claims 5, wherein the shroud is ring-shaped such that an internal diameter of the outer ring is equal to or larger than an external diameter of the ring-shaped shroud.

8. The turbofan as set forth in claim 5, wherein each of the blades is integrally formed with the rotating plate and the outer ring at opposite ends of the rear portion of each of the plurality of blades.

9. The turbofan as set forth in claims 5, wherein the spacing between the rotating plate and the outer ring is a uniform annular spacing.

10. The turbofan as set forth in claims 5, wherein a radial width of each of the plurality of blades is larger than a radial width of the spacing between the rotating plate and the outer ring.

11. The turbofan as set forth in claim 5, wherein a center of the rotating plate protrudes forward into a dome shape.

12. The turbofan as set forth in claims 5, wherein each of the plurality of blades are inclined at a common angle with respect to a radial direction of a respective blade.

13. The turbofan as set forth in claim 5, wherein the shroud is curled at an inner peripheral portion thereof to have a specific curvature.

14. The turbofan as set forth in claim 5, wherein each of the plurality of blades comprises:

inner and outer ends such that the rotating plate and the outer ring are integrally molded via the plurality of blades by the inner and outer ends of the plurality of blades, the inner and outer ends being extending portions of the plurality of blades.

* * * * *

UNITED STATES PATENT AND TRADEMARK OFFICE

CERTIFICATE OF CORRECTION

PATENT NO. : 7,121,799 B2
APPLICATION NO. : 10/748230
DATED : October 17, 2006
INVENTOR(S) : Jin Baek Kim et al.

It is certified that error appears in the above-identified patent and that said Letters Patent is hereby corrected as shown below:

Title Page, Column 2 (U.S. Patent Documents), Line 2, after "Kim" change "416/186 R" to --416/186.00 R--

Column 6, Line 9, change "claims 5," to --claim 5,--

Column 6, Line 17, change "claims 5," to --claim 5,--

Column 6, Line 20, change "claims 5," to --claim 5,--

Column 6, Line 26, change "claims 5," to --claim 5,--

Signed and Sealed this

Sixth Day of March, 2007

JON W. DUDAS
*Director of the United States Patent and Trademark Office*